US007166406B2

(12) United States Patent
McAneney et al.

(10) Patent No.: US 7,166,406 B2
(45) Date of Patent: Jan. 23, 2007

(54) PREVENTION OR REDUCTION OF THERMAL CRACKING ON TONER-BASED PRINTS

(75) Inventors: T. Brian McAneney, Burlington (CA); Kurt I. Halfyard, Mississauga (CA); Gordon Sisler, St. Catharines (CA)

(73) Assignee: Xerox Corporation, Stamford, CT (US)

( * ) Notice: Subject to any disclaimer, the term of this patent is extended or adjusted under 35 U.S.C. 154(b) by 316 days.

(21) Appl. No.: 10/838,213

(22) Filed: May 5, 2004

(65) Prior Publication Data

US 2005/0250038 A1 Nov. 10, 2005

(51) Int. Cl.
*G03G 15/20* (2006.01)

(52) U.S. Cl. ..... 430/124; 522/178

(58) Field of Classification Search ..... 430/124; 522/178

See application file for complete search history.

(56) References Cited

U.S. PATENT DOCUMENTS 4,070,262 A 1/1978 Guarino et al.
4,071,425 A 1/1978 Guarino et al.
4,072,592 A 2/1978 Dué et al.
4,072,770 A 2/1978 Ting
4,092,173 A 5/1978 Novak
4,133,909 A 1/1979 Spencer
4,265,976 A 5/1981 Nowak
4,265,990 A 5/1981 Stolka et al.
4,333,963 A * 6/1982 Emmons et al. ..... 427/506
4,426,431 A 1/1984 Harasta et al.
4,477,548 A 10/1984 Harasta et al.
4,563,408 A 1/1986 Lin et al.
4,584,253 A 4/1986 Lin et al.
4,585,884 A 4/1986 Lin et al.
5,162,389 A 11/1992 Lee et al.
5,219,641 A 6/1993 Mehta et al.
5,223,368 A 6/1993 Ciccarelli et al.
5,346,795 A 9/1994 Pickering et al.
5,366,840 A 11/1994 Larson et al.
5,612,777 A 3/1997 Malhotra
5,627,002 A 5/1997 Pan et al.
5,800,884 A 9/1998 D'Anna et al.
5,826,147 A 10/1998 Liu et al.
5,905,012 A 5/1999 De Meutter et al.
5,966,570 A 10/1999 Till et al.
6,162,511 A * 12/2000 Garnett et al. ..... 427/514
6,180,308 B1 1/2001 Pan et al.
6,187,499 B1 2/2001 Zhao et al.
6,212,347 B1 4/2001 Zhao et al.

FOREIGN PATENT DOCUMENTS

EP 0 823 670 A1 2/1998

* cited by examiner

*Primary Examiner*—John L Goodrow
(74) *Attorney, Agent, or Firm*—Oliff & Berridge, PLC

(57) ABSTRACT

Overprint compositions for toner-based prints containing at least one radiation oligomer/monomer, at least one photo-initiator, and at least one surfactant are disclosed. The overprint compositions provide a number of advantages to toner-based prints, such as, for example, those subjected to abrasives, heat, and/or sunlight since the compositions protect such images from cracking, fading, and smearing. In addition, the overprint compositions provide resistance to thermal cracking, which is assessed by image analysis of the thermal crack area after exposure of the print to thermal shock.

17 Claims, 3 Drawing Sheets

PREVENTION OR REDUCTION OF THERMAL CRACKING ON TONER-BASED PRINTS

BACKGROUND OF THE INVENTION

1. Field of Invention

The present invention generally relates to overprint compositions for coating toner-based prints that provide a number of advantages to toner-based prints, such as, for example, image permanence, thermal stability, lightfastness, and smear resistance. The invention further relates to reducing or preventing thermal cracking by assessing the degree of thermal cracking on coated toner-based prints after thermal shock.

2. Description of Related Art

In conventional methods of generating toner-based images, such as in xerographic methods, electrostatic latent images are formed on a xerographic surface by uniformly charging a charge retentive surface, such as a photoreceptor. The charged area is then selectively dissipated in a pattern of activating radiation corresponding to the original image. The latent charge pattern remaining on the surface corresponds to the area not exposed by radiation. Next, the latent charge pattern is visualized by passing the photoreceptor past one or more developer housings comprising toner, which adheres to the charge pattern by electrostatic attraction. The developed image is then fixed to the imaging surface or is transferred to a receiving substrate, such as paper, to which it is fixed by a suitable fusing technique, resulting in a xerographic print or toner-based print.

Known methods of protecting prints include adding wax to the toner for toner-based prints and applying an overprint coating to the substrate to protect the print from abrasives and provide scratch resistance, for example, for toner-based and ink-based prints. The overprint coating, often referred to as an overprint varnish or composition, is typically a liquid film coating that can be dried and/or cured. Curing is generally accomplished through drying or heating or by applying ultraviolet light or low voltage electron beams to polymerize (crosslink) the components of the overcoat. However, known overprint coating, such as those described in U.S. Pat. Nos. 4,070,262, 4,071,425, 4,072,592, 4,072,770, 4,133,909, 5,162,389, 5,800,884, 4,265,976, and 5,219,641, for example, fail to adequately protect toner-based prints.

For example, coatings specifically created to coat ink-based prints do not function effectively on toner-based prints due to a mismatch in the coefficient of thermal expansion between the coating resin and the toner resin. Thus, when the toner-based print is exposed to elevated temperatures and/or pressures, the toner expands causing the formation of hairline cracks on the surface of the print. The hairline cracks expose the substrate which, in turn, makes the cracks highly visible and degrades the quality of the image. This is a particularly important issue for automobile manuals, book covers, etc., which require the prints therein to survive high temperatures for hours at a time, yet retain a neat appearance. Similarly, known coatings that can be applied to toner-based prints do not effectively prevent or reduce toner-specific problems, such as, for example, thermal cracking and document offset.

Moreover, known coating formulations fail to protect xerographic prints from bead-up and smears caused by overwriting on the print with liquid markers. The ability to neatly overwrite without beading and smearing is vital for numerous commercial applications, such as, for example, restaurant menus and calendars.

Accordingly, a need exists for a protective composition that provides overprint coating properties including, but not limited to, thermal and light stability and smear resistance, particularly in commercial print applications. More specifically, a need exists for an overprint coating that has the ability to wet over silicone fuser oil (generally found on xerographic substrates), permit overwriting, reduce or prevent thermal cracking, reduce or prevent document offset, and protect an image from sun, heat, etc. The compositions and processes of the present invention, wherein a toner-based print is coated with a radiation curable overprint composition, satisfies this need.

SUMMARY OF THE INVENTION

The present invention is directed to methods for producing toner-based prints that resist thermal cracking, after exposure to thermal shock, and are able to withstand heat, sunshine, pressure, and abrasives without scratching, permit overwriting, and resist document offset. Thus, the invention is further directed to radiation curable overprint compositions designed to provide image permanence and stability, even when the print is subjected to heat, light, abrasives, and/or pressure.

In addition, the inventive overprint compositions improve the overall appearance of toner-based prints due to the ability of the compositions to fill in the roughness of xerographic substrates and toners, thereby forming a level film and enhancing glossiness. This is desirable in reducing or eliminating differential gloss that is often observed when different pile heights of toner are applied to make a color image, for example. It is especially noticeable when a black portion of an image is adjacent to a nearly white portion of the image. With the inventive overprint composition applied, the difference is negligible.

The invention further relates to toner-based prints comprising a radiation curable, preferably, ultraviolet (UV) curable, overprint composition applied to at least one surface of a print substrate. The UV curable overprint composition applied comprises a homogeneous mixture of UV curable oligomers/monomers, photoinitiators, and surfactants. By coating the print with the inventive composition, the toner is effectively buried beneath an overcoat, which functions as a protective barrier after curing.

The ability of the overprint compositions, after curing, to protect toner-based prints from thermal cracking, or at least reduce the occurrence of thermal cracking, can be quantified by measuring the Thermal Crack Area (TCA), after exposure to thermal shock, e.g., high temperature and/or pressure, using an image analysis system. The higher the TCA value, the more visible the cracks and the greater the degradation in image quality. Radiation curable overprint compositions that protect toner-based prints from thermal cracking have a TCA value in the range of about 0% to about 0.05% (after thermal shock), preferably, less than about 0.05%, depending on scanner noise.

In embodiments of the present invention, the overprint composition, after curing and exposure to thermal shock, exhibits no cracking, or at least substantially no cracking. By "substantially no cracking" is meant that the overprint composition-coated print, after overprint composition curing and print exposure to thermal shock, exhibits no cracking, at least within the degree of measurement error in the method used to measure or determine such cracking. For example, where cracking is measured or determined using TCA values, described herein, the preferred TCA value is less than about 0.05%. Thus, in embodiments, the TCA value is from about 0.0 to about 0.05% after exposure to thermal shock, preferably, less than about 0.05%, depending upon scanner noise due to scanner resolution variations, for example.

The invention further relates to processes for forming toner-based prints comprising generating an electrostatic image, developing the electrostatic image with a toner, transferring the developed toner-based image to a substrate, applying to the developed toner-based image a radiation curable overprint composition, and curing the composition, whereby the resulting toner-based print is protected from thermal cracking upon exposure to thermal shock.

DETAILED DESCRIPTION OF PREFERRED EMBODIMENTS

Figure 1A:
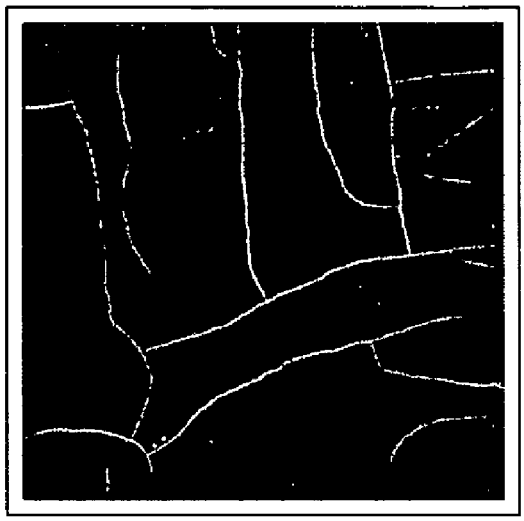
FIGS. 1A–1F are photographs illustrating thermal cracking on toner-based prints coated with Sun Chemicals coating #1170 (Sun Chemical Corp., New York, N.Y.), Sovereign Chemicals coating #L9048 (Sovereign Specialty Chemicals, Inc., Chicago, Ill.), and an inventive overprint composition.
Figure 1B:
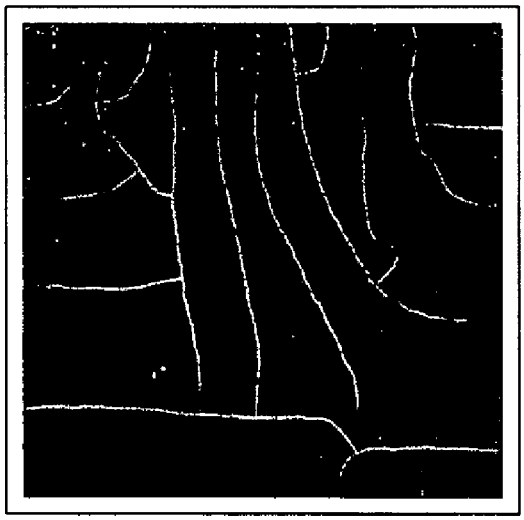
Figure 1C:
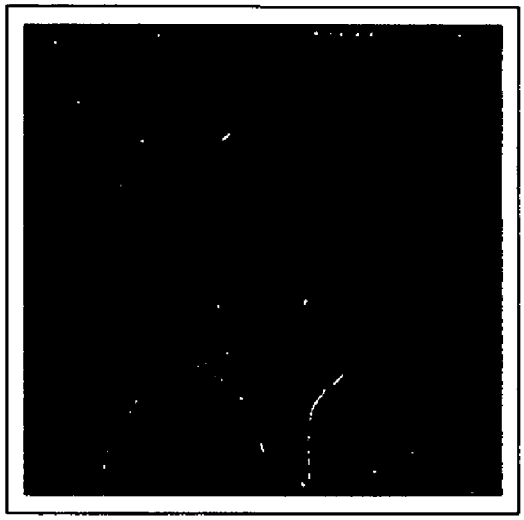
Figure 1D:
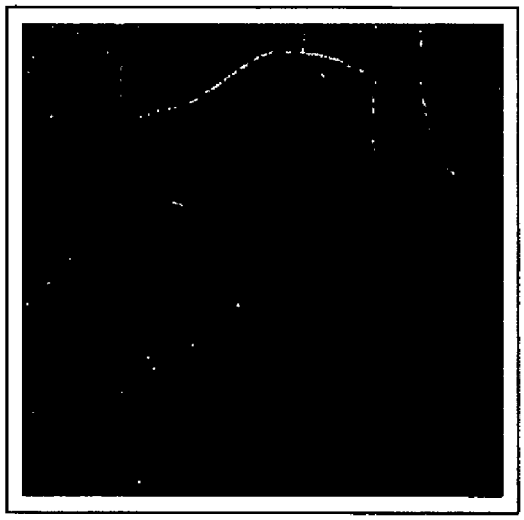

The present invention provides solvent-free, radiation curable overprint compositions comprising at least one radiation curable oligomer/monomer, at least one photoinitiator, and at least one surfactant.

In the uncured state, the composition is a low viscous liquid. Upon exposure to a suitable source of curing energy, e.g., ultraviolet light, electron beam energy, etc., the photoinitiator absorbs the energy and sets into motion a reaction that converts the liquid composition into a cured overcoat. The monomer and oligomer in the composition contain functional groups that polymerize during exposure to the curing source and readily crosslink forming a polymer network. This polymer network provides xerographic prints with, for example, thermal and light stability and smear and scratch resistance. Thus, the composition is particularly well-suited for coating images on substrates subjected to heat and sunlight since the composition protects the image from cracking and fading, provides image permanence, and allows for overwriting in the absence of smearing and beading.

Another advantage of the overprint compositions is its ability to protect xerographic prints from electron beam irradiation, such as the type of irradiation used on certain mail addressed to particular United States governmental agencies to kill bacteria and viruses. Very high irradiation levels are required at temperatures of about 95–110° C., causing visible steaming. Thus, irradiated mail is often yellow and paper is often brittle. Compact disks, floppy disks, and other plastics melt and do not survive the irradiation process. In addition, most toner-based documents suffer from document offset, and thus stick together, after irradiation. The overprint compositions allow such documents to survive irradiation intact.

Overprint Compositions

The overprint compositions comprise, in general, at least one radiation curable oligomer/monomer, at least one photoinitiator, and at least one surfactant. More specifically, the overprint compositions comprise at least one acrylated oligomer, polyether, or polyester acrylate, such as, for example, a high molecular weight, low viscosity, unsaturated trifunctional acrylic resin; at least one low surface tension, low viscosity di- or tri-functional acrylate monomer; at least one UV-photoinitiator used to initiate the photopolymerization, i.e., curing, of the chemically unsaturated prepolymer (oligomer and monomer); and at least one surfactant.

The oligomer component of the composition is preferably relatively hydrophobic. Such oligomers help provide the radiation-cured layer of the print with the requisite moisture barrier properties because, as the hydrophobicity of the oligomer increases, the moisture barrier properties improve. As a result, moisture is less likely to permeate into the base paper, which minimizes paper cockling and curling. Suitable acrylated oligomers include, but are not limited to, acrylated polyesters, acrylated polyethers, acrylated epoxys, and urethane acrylates. Preferred oligomers include, but are not limited to, polyether acrylate oligomers, having the basic structure:

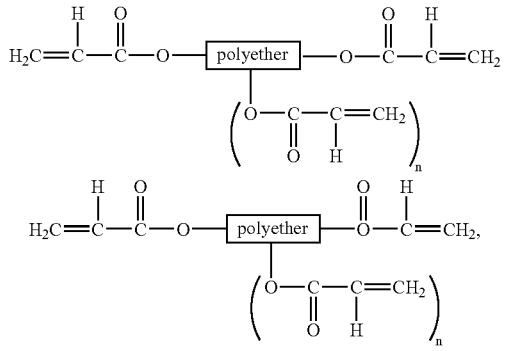

such as, for example, Laromer® PO94F (BASF Corp., Charlotte, N.C.), an amine-modified polyether acrylate oligomer.

The monomer functions as a viscosity reducer, as a binder when the composition is cured, as an adhesion promoter, and as a crosslinking agent, for example. Suitable monomers have a low molecular weight, low viscosity, and low surface tension and comprise functional groups that undergo polymerization upon exposure to UV light. The monomers are preferably polyfunctional alkoxylated or polyalkoxylated acrylic monomers comprising one or more di- or tri-acrylates. Suitable polyfunctional alkoxylated or polyalkoxylated acrylates may be selected from alkoxylated, preferably, ethoxylated, or propoxylated, variants of the following: neopentyl glycol diacrylates, butanediol diacrylates, trimethylolpropane triacrylates, and glyceryl triacrylates. In a more preferred embodiment, the monomer is a propoxylated$_2$ neopentyl glycol diacrylate, such as, for example, SR-9003 (Sartomer Co., Inc., Exton, Pa.), having the structure:

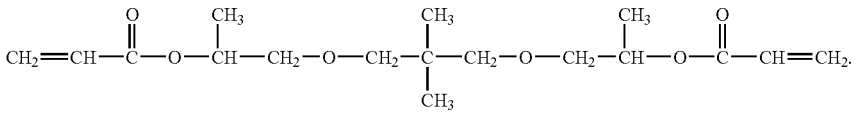

Suitable photoinitiators are UV-photoinitiators, including, but not limited to, hydroxycyclohexylphenyl ketones, benzoins, benzoin alkyl ethers, benzophenones, trimethylbenzoylphenylphosphine oxides, azo compounds, anthraquinones and substituted anthraquinones, such as, for example, alkyl substituted or halo substituted anthraquinones, other substituted or unsubstituted polynuclear quinones, acetophones, thioxanthones, ketals, acylphosphines, and mixtures thereof. More preferably, the photoinitiator is one of the following compounds or a mixture thereof: a hydroxyclycyclohexylphenyl ketone, such as, for example, 1-hydroxycyclohexylphenyl ketone, such as, for example, Irgacure® 184 (Ciba-Geigy Corp., Tarrytown, N.Y.), having the structure:

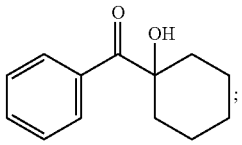

a trimethylbenzoylphenylphosphine oxide, such as, for example, ethyl-2,4,6-trimethylbenzoylphenylphosphinate, such as, for example, Lucirin® TPO-L (BASF Corp.), having the structure:

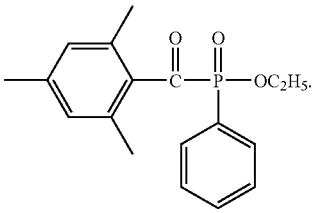

The fourth main ingredient, a surfactant, is generally used to lower the surface tension of the composition to allow wetting and leveling of the substrate surface, if necessary, before curing. Any surfactant that has this capability may be used. Preferred surfactants include, but are not limited to, fluorinated alkyl esters, polyether modified polydimethylsiloxanes, having the structure:

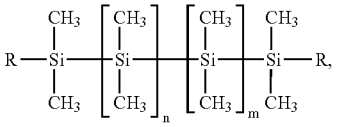

wherein the R groups are functional modifications, such as, for example, BYK®-UV3510 (BYK Chemie GmbH, Wesel, Germany), and BYK®-348 (BYK Chemie GmbH), such as, for example, BYK®-UV3510 (BYK Chemie GmbH, Wesel, Germany) and BYK®-348 (BYK Chemie GmbH), and fluorosurfactants, such as, for example, Zonyl® FSO-100 (E.I. Du Pont de Nemours and Co., Wilmington, Del.), having the formula $R_fCH_2CH_2O(CH_2CH_2O)_xH$, wherein $R_f=F(CF_2CF_2)_y$, x=0 to about 15, and y=1 to about 7.

Optional additives include, but are not limited to, light stabilizers, UV absorbers, which absorb incident UV radiation and convert it to heat energy that is ultimately dissipated, antioxidants, optical brighteners, which can improve the appearance of the image and mask yellowing, thixotropic agents, dewetting agents, slip agents, foaming agents, antifoaming agents, flow agents, waxes, oils, plasticizers, binders, electrical conductive agents, fungicides, bactericides, organic and/or inorganic filler particles, leveling agents, e.g., agents that create or reduce different gloss levels, opacifiers, antistatic agents, dispersants, pigments and dyes, and the like. The composition may also include an inhibitor, preferably a hydroquinone, to stabilize the composition by prohibiting or, at least, delaying, polymerization of the oligomer and monomer components during storage, thus increasing the shelf life of the composition. However, additives may negatively effect cure rate, and thus care must be taken when formulating an overprint composition using optional additives.

The ability of the composition to wet the substrate generally depends on its viscosity and surface tension. For example, if the surface tension is low, then the surface area covered by the composition will be high resulting in sufficient wetting of the substrate. Preferred composition formulations have a surface tension ranging from about 15 dynes/cm to about 40 dynes/cm, and, more preferably, ranging from about 18 dynes/cm to about 21 dynes/cm, as measured at about 25° C. The preferred surface tension is about 20 dynes/cm as measured at about 25° C.

The viscosity of the compositions ranges from about 50 cP to about 300 cP, depending on the temperature. Preferably, the viscosity of the compositions ranges from about 100 cP to about 200 cP at a temperature ranging from about 20° C. to about 30° C. A more preferred viscosity is about 100 cP at about 25° C. To obtain an acceptable viscosity, the preferred oligomer:monomer ratio is about 0.67:1 to about 9:1, more preferably, from about 1.5:1 to about 4:1.

The composition components are preferably mixed together in the following order: about 60 to about 70% oligomer including, but not limited to, a polyether acrylate oligomer, such as, for example, Laromer® PO94F (BASF Corp.) in a concentration of about 67.8%; about 20 to about 40% monomer including, but not limited to, a propoxylated$_2$ neopentyl glycol diacrylate, such as, for example, SR-9003 (Sartomer Co., Inc.) in a concentration of about 27%; about 2.0 to about 7.0% UV-photoinitiator, including, but not limited to, 1-hydroxyclyclohexylphenyl ketone, such as, for example, Irgacure® 184 (Ciba-Geigy Corp.) in a concentration of about 5.1%; and about 0.05 to about 5.0% surfactant, more preferably, about 0.1 to about 1.0% surfactant, including, but not limited to, a polyether modified polydimethylsiloxane, such as, for example, BYK®-UV3510 (BYK Chemie GmbH) in a concentration of about 0.1%. The components are combined and mixed with brief agitation using, preferably, a magnetic stir bar or overhead mixer between each addition, followed by a minimum of about two hours of stirring until the oligomer is dissolved. The formulation can be heated to reduce viscosity, if necessary.

Overprint Composition Application Methods

The composition can be applied to any type of xerographic substrate, such as, for example, paper, including wherein the substrate has a residue of fuser-oil (functionalized silicone oil), to completely wet the surface with no surface reaction optionally comprising additives coated thereon. The substrate can contain additives including, but not limited to, anti-curl compounds, such as, for example, trimethylolpropane; biocides; humectants; chelating agents; and mixtures thereof; and any other optional additives well known in the xerographic art for enhancing the performance and/or value of the toner and/or substrate.

The composition can be applied to the print substrate at any suitable time after image formation and can be applied over the entire substrate, the entire image, parts of the substrate, or parts of the image. Preferably, the toner-based image on the substrate has been previously prepared by any suitable xerographic process comprising, for example, generating an electrostatic image, developing the electrostatic image with toner, and transferring the developed toner-based image to a substrate, or modifications thereof, well-known in the art of xerography.

More specifically, methods for generating images coated with the overprint compositions disclosed herein comprise: generating an electrostatic latent image on a photoconductive imaging member, developing the latent image with toner, transferring the developed electrostatic image to a substrate, coating the substrate or parts thereof and/or image or parts thereof with an overprint composition, and curing the composition. Development of the image can be achieved by a number of methods known in the art, such as, for example, cascade, touchdown, powder cloud, magnetic brush, and the like. Transfer of the developed image to the substrate can be by any method, including, but not limited to, those making use of a corotron or a biased roll. The fixing step can be performed by means of any suitable method, such as, for example, flash fusing, heat fusing, pressure fusing, vapor fusing, and the like. Suitable imaging methods, devices, and systems are known in the art and include, but are not limited to, those described in U.S. Pat. Nos. 4,585,884, 4,584,253, 4,563,408, 4,265,990, 6,180,308, 6,212,347, 6,187,499, 5,966,570, 5,627,002, 5,366,840; 5,346,795, 5,223,368, and 5,826,147, the entire disclosures of which are incorporated herein by reference.

Conventional liquid film coating devices can be used for applying the overprint composition, including, but not limited to, roll coaters, rod coaters, blades, wire bars, dips, air-knives, curtain coaters, slide coaters, doctor-knives, screen coaters, gravure coaters, such as, for example, offset gravure coaters, slot coaters, and extrusion coaters. Such devices can be used in their conventional manner, such as, for example, direct and reverse roll coating, blanket coating, dampner coating, curtain coating, lithographic coating, screen coating, and gravure coating. In a preferred embodiment, coating and curing of the composition are accomplished using a two or three roll coater with a UV curing station. Typical composition deposition levels, expressed as mass per unit area, range from about 1 $g/m^2$ to about 10 $g/m^2$, and are preferably, about 5 $g/m^2$.

The energy source used to initiate crosslinking of the radiation curable oligomer and monomer components of the composition can be actinic, e.g., radiation having a wavelength in the ultraviolet or visible region of the spectrum, accelerated particles, e.g., electron beam radiation, thermal, e.g., heat or infrared radiation, or the like. Preferably, the energy is actinic radiation because such energy provides excellent control over the initiation and rate of crosslinking. Suitable sources of actinic radiation include, but are not limited to, mercury lamps, xenon lamps, carbon arc lamps, tungsten filament lamps, lasers, sunlight, and the like.

Ultraviolet radiation, especially from a medium pressure mercury lamp with a high speed conveyor under UV light, e.g., about 20 to about 70 m/min., is preferred, wherein the UV radiation is provided at a wavelength of about 200 to about 500 nm for about less than one second. More preferably, the speed of the high speed conveyor is about 15 to about 35 m/min. under UV light at a wavelength of about 200 to about 450 nm for about 10 to about 50 milliseconds (ms). The emission spectrum of the UV light source generally overlaps the absorption spectrum of the UV-initiator. Optional curing equipment includes, but is not limited to, a reflector to focus or diffuse the UV light, and a cooling system to remove heat from the UV light source.

Assessing Thermal Cracking

After the composition has been applied and cured and the print has been exposed to thermal shock, the Thermal Crack Area (TCA) can be determined, for example, by a method comprising: scanning the image on the coated print; importing the scanned image into a computer-readable image format; saving the computer formatted image; and analyzing the image using an image builder program. The preferred TCA value is about 0.0 to about 0.05% after exposure to thermal shock, preferably, less than about 0.04%, more preferably, less than about 0.03%, even more preferably, less than 0.02%, even more preferably, less than about 0.01%, depending upon scanner noise due to scanner resolution variations.

More specifically, TCA is determined by a method comprising: scanning an image on a coated print using, for example, a flat-bed scanner, such as, for example, the Power Look® III scanner (Umax Data Systems Inc., Hsichu, Taiwan), to convert the image into digital data. When scanning an image, the following settings are preferred: a high resolution, such as, for example, about 600 dpi; a high brightness setting, such as, for example, about 255; a contrast setting of about 0; and a high gamma setting, such as, for example, about 3.0;

importing and saving the scanned image into a computer-readable image format, such as, for example, a tagged image file (.tif), bitmap file (.bmp), graphic interchange file (.gif), Apple® Macintosh® Picture file (.pict) (Apple Computer, Inc., Cupertino, Calif.), joint photographic experts group file (.jpeg), encapsulated postscript file (.eps), or photoshop document file (.psd), as applicable, using any suitable image editing program, such as, for example, an Adobe Photoshop® program (Adobe Systems, Inc., San Jose, Calif.). The "no compression" setting on the editing program software is preferred, and thus file formats suitable for this setting are preferred; and analyzing the image using any suitable image builder program, such as, for example, National Instruments® IMAQ® Image Builder 6.0 (National Instruments Corp., Austin, Tex.), and a minimum image area of about 800×800 pixels (about 640000 pixels). Preferably, a particle filter is used to remove about 0 to about 50 pixel spots due to scanner noise, etc. In the image analysis, a thresholded image is generated and a pixel count is applied to the thresholded image to obtain the TCA value.

The image builder program may be used to view the thresholded image, which is the scanned and subsequently edited image segmented into a particle region and a background region. In a monochrome image, generally, one threshold interval, also known as the gray-level interval, is determined, such that all pixels above the threshold interval have a value of one and all pixels below the threshold interval have a value of zero (binary image). In a color image, three threshold intervals must be determined—one for each color component of the thresholded image.

For TCA analysis, the threshold interval for a solid black target is 76 (on scale of 0–255) on an image containing at least about 640,000 pixels. Thus, thresholded images having greater than 0.1% of the pixels above the threshold value of 76 exhibit thermal cracking, whereas thresholded images having less than about 0.1% of the pixels below the 76 threshold value do not exhibit thermal cracking.

The invention will be illustrated further in the following nonlimiting Examples. The Examples are intended to be illustrative only. The invention is not intended to be limited to the materials, conditions, process parameters, and the like, recited herein. Parts and percentages are by weight unless otherwise indicated.

EXAMPLES

Example 1

Overprint Composition Formulation

The components of the overprint composition were combined in the following order with brief agitation between each addition with an overhead mixer: 67.8% amine modified polyether acrylate oligomer (3388 grams Laromer® PO94F (BASF Corp.)), 27% propoxylated$_2$ neopentyl glycol diacrylate (1351 grams SR-9003 (Sartomer Co., Inc.)), 5.1% UV photoinitiator (1-hydroxyclyclohexylphenyl ketone (241 grams Irgacure® 184 (Ciba-Geigy Corp.)) and ethyl-2,4,6-trimethylbenzoylphenylphosphinate (15 grams Lucirin® TPO-L (BASF Corp.))), and 0.1% polyether modified polydimethylsiloxane (5.0 grams BYK®-UV3510 (BYK Chemie GmbH)). The mixture was stirred at room temperature for about four hours at high shear with an overhead mixer until the oligomer dissolved.

The overprint composition was coated on a variety of xerographic prints at a thickness of about 5 microns. The composition was subsequently cured using a Dorn SPE three roll coater (Dorn SPE, Inc.) with a UV curing station housing a medium pressure mercury lamp with a high speed UV light (about 15 to about 35 m/min.) and a UV wavelength of about 200 to about 450 nm.

Example 2

Audi Thermal Shock Test for Measuring Thermal Cracking

A commercially available coating (#L9048 from Sovereign Chemicals (Sovereign Specialty Chemicals, Inc.)) was applied to several substrates containing either iGen3® (Xerox Corp.) toner or offset ink. The substrates were then subjected to the "Audi Thermal Shock Test" with 4 g/cm$^2$ pressure (simulating approximately 2 reams of CX paper) under the various conditions set forth in Table 1. This test is an actual test used by Audi in evaluating its automobile manuals.

TABLE 1

Audi Thermal Shock Test

| Temperature | Time |
|---|---|
| Increase temperature from 23° C. (room temp.) to 70° C. | 2 hours |
| Hold @ 70° C. | 4 hours |
| Decrease temperature from 70° C. to −40° C. | 2 hours |
| Hold @ −40° C. | 4 hours |
| Increase temperature from −40° C. to 70° C. | 2 hours |
| Hold @ 70° C. | 4 hours |
| Decrease temperature from 70° C. to −40° C. | 2 hours |
| Hold @ −40° C. | 4 hours |
| Increase temperature from −40° C. to 23° C. | 2 hours |

The key indicator of thermal cracking in the Audi Thermal Shock Test is the appearance of cracks on the substrate due to pressure from flowing toner. The offset ink samples showed no indication of cracking under the coating material in the Audi Thermal Shock Test, whereas the toner samples did show cracks (Table 2). The substrates were McCoy Gloss (Sappi Fine Papers), McCoy Silk (Sappi Fine Papers), and KromeKote® (Smart Papers, LLC, Hamilton, Ohio).

TABLE 2

Thermal Cracking of iGen3 ® (Xerox Corp.) Toner vs. Offset Ink (Roll = 50, Line = 100, Lamp = 300, Thickness = nominal)

| Sample No. | Coating | Substrate | Toner/Offset Ink | Cracking |
|---|---|---|---|---|
| 1 | L9048 | KromeKote ®+ | Toner | Yes |
| 1 | L9048 | McCoy Silk | Toner | Yes |
| 1 | L9048 | McCoy Gloss | Toner | Yes |
| 2 | L9048 | McCoy Gloss | Ink | No |
| 2 | L9048 | McCoy Silk | Ink | No |
| 2 | L9048 | KromeKote ®+ | Ink | No |

Example 3

Comparative Example Using the Audi Thermal Shock Test

Two commercial coatings (Sovereign Chemicals #L9048 (Sovereign Specialty Chemicals, Inc.) and Sun Chemicals #1170 (Sun Chemical Corp.)) and the overprint composition prepared in Example 1 were evaluated under identical conditions and subjected to the Audi Thermal Shock Test. The coated substrates (McCoy Gloss 100# Cover (Sappi Fine Papers) and Xerox® Digital Gloss 100# Cover (Xerox Corp.)) with iGen3® (Xerox Corp.) toner-based images were subjected to the Audi Thermal Shock Test with 4 g/cm$^2$ pressure (simulating approximately 2 reams of CX paper) under the various conditions set forth in Table 1.

Figure 1E:
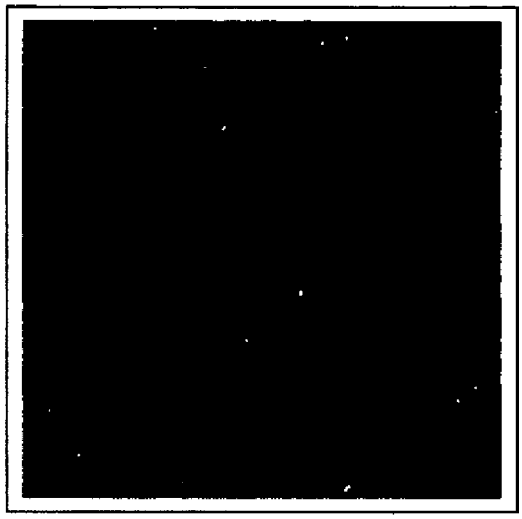
Figure 1F:
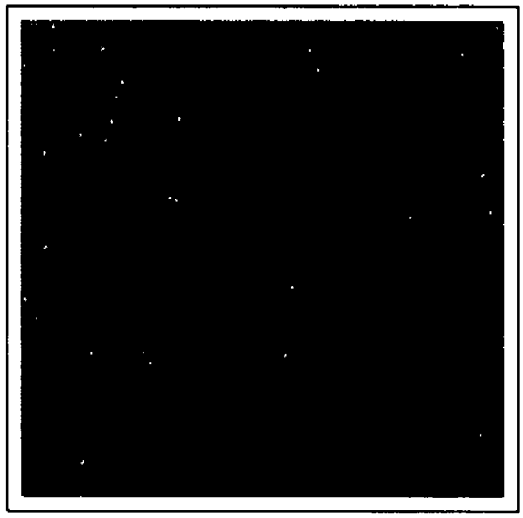

FIG. 1 illustrates that severe thermal cracking occurred using the Sun Chemicals #1170 (Sun Chemical Corp.) coating (FIGS. 1A–1B), substantial thermal cracking occurred using the Sovereign Chemicals #L9048 (Sovereign Specialty Chemicals, Inc.) coating (FIGS. 1C–1D), and no thermal cracking occurred using the inventive overprint composition (OPV-3) (FIGS. 1E–1F). Table 3 confirms the results shown in FIGS. 1A–1F.

TABLE 3

Thermal Cracking (Roll = 50, Line = 100, Lamp = 300, Thickness = nominal)

| Sample No. | Coating | Substrate | Cracking |
|---|---|---|---|
| 6 | Sun Chemicals #1170 | McCoy Gloss | Yes |
| 6 | Sun Chemicals #1170 | Xerox ® Digital Gloss | Yes |
| 1 | Sovereign Chemicals #L9048 | McCoy Gloss | Yes |
| 1 | Sovereign Chemicals #L9048 | Xerox ® Digital Gloss | Yes |
| 3 | OPV-3 | McCoy Gloss | No |
| 2 | OPV-3 | Xerox ® Digital Gloss | No |

Example 4

Thermal Crack Area (TCA) Determination

Two commercial coatings (Sovereign Chemicals #L9048 (Sovereign Specialty Chemicals, Inc.) and Sun Chemicals

#1170 (Sun Chemical Corp.)) and the overprint composition of Example 1 were evaluated under identical conditions and subjected to the Audi Thermal Shock Test (Table 1) after coating and curing on the following substrates: McCoy Gloss (Sappi Fine Papers), McCoy Silk (Sappi Fine Papers), Xerox® Digital Gloss (Xerox Corp.), and KromeKote® (Smart Papers, LLC, Hamilton, Ohio) containing iGen3® (Xerox Corp.) toner-based images (100% black images).

The TCA value was determined by (1) scanning the images on the prints using a Power Look® III scanner (Umax Data Systems Inc.) with the following settings—resolution 600 dpi, brightness 255, contrast 0, gamma 3.0; (2) importing and saving the images into a .tif format using Adobe Photoshop® 7.0 (Adobe Systems, Inc.) with no compression; and (3) analyzing the images using National Instruments® IMAQ® Image Builder 6.0 (National Instruments Corp.) and a minimum image area of 800×800 pixels. The threshold interval was a pixel count of 76 (on scale of 0–255) (above 76=cracking, below 76=not cracking). A particle filter was applied to remove 0–50 pixel spots (scanner noise, etc.). Only the inventive overprint composition had an acceptable average TCA value, i.e., about 0% to about 0.05%.

TABLE 4

TCA Values of Overprint Compositions on Toner-Based Prints

| Overprint Composition | Substrate | Average TCA (n = 3) |
|---|---|---|
| OPV-3 | McCoy Gloss | 0.01% |
| OPV-3 | Xerox ® Digital Gloss | 0.02% |
| Sovereign Chemicals #L9048 | KromeKote ® | 0.51% |
| Sovereign Chemicals #L9048 | McCoy Gloss | 0.10% |
| Sovereign Chemicals #L9048 | Xerox ® Digital Gloss | 0.33% |
| Sovereign Chemicals #L9048 | McCoy Silk | 0.91% |
| Sun Chemicals #1170 | KromeKote ® | 3.12% |
| Sun Chemicals #1170 | McCoy Silk | 2.76% |

Example 5

Electron Beam Radiation Test

Xerographic prints on Xerox® Digital Colour Gloss 100# (Xerox Corp.) were left uncoated or coated with approximately 5 gsm of the overprint composition of Example 1 and subjected to a normal dose of electron beam irradiation, i.e., the prints were run through an electron beam system twice, wherein the temperature was approximately 95–110° C. The steaming prints were allowed to cool naturally for several hours and then observed.

As described in Table 5, the coated prints successfully survived the irradiation process indicating a resistance to both the irradiation and the secondary heat to which the prints were subjected during the irradiation process. The first two samples in Table 5 represent different types of mail, e.g., folded versus not folded.

TABLE 5

E-Beam Irradiation on Xerographic Prints

| Toner | Paper | Overcoat | Comment |
|---|---|---|---|
| iGen3 ® | Coated | None | solid block, severe offset damage |
| iGen3 ® | Coated | None | in contact with other paper, could be peeled, severe offset damage, paper tearing |

TABLE 5-continued

E-Beam Irradiation on Xerographic Prints

| Toner | Paper | Overcoat | Comment |
|---|---|---|---|
| iGen3 ® | Coated | Yes (Example 1) | no sticking, no damage |
| NexPress ® | Coated | None | severe damage |

Toner = iGen3 ® (Xerox Corp.) or NexPress ® (NexPress Solutions, Rochester, NY)

While the invention has been described with reference to the specific embodiments, it will be apparent to those skilled in the art that many alternatives, modifications, and variations can be made. It is intended to embrace such alternatives, modifications, and variations as may fall within the spirit and scope of the appended claims.

All the patents, publications, and articles referred to herein are hereby incorporated by reference in their entirety.

What is claimed is:

1. An overprint composition, comprising:

at least one oligomer chosen from the group consisting of polyether acrylate oligomers, at least one monomer chosen from the group consisting of di-acrylate monomers, alkoxylated di-acrylate monomers, polyalkoxylated di-acrylate monomers, tri-acrylate monomers, alkoxylated tri-acrylate monomers, polyalkoxylated tri-acrylate monomers, at least one photoinitiator, and at least one surfactant;

wherein the overprint composition is radiation curable;

wherein an oligomer:monomer ratio is in a range of from about 1.5:1 to about 4:1; and wherein the overprint composition-coated print, after curing, has a thermal cracking area value of about 0% to about 0.05% after thermal shock.

2. The overprint composition of claim 1, wherein the oligomer is a modified polyether acrylate oligomer.

3. The overprint composition of claim 1, wherein the monomer is selected from the group consisting of neopentyl glycol diacrylates, butanediol diacrylates, trimethylolpropane triacrylates, and glyceryl triacrylates.

4. The overprint composition of claim 3, wherein the monomer is a propoxylated$_2$ neopentyl glycol diacrylate.

5. The overprint composition of claim 1, wherein the surfactant is a polyether modified polydimethylsiloxane or a fluorosurfactant.

6. The overprint composition of claim 1, wherein the photoinitiator is selected from the group consisting of hydroxycyclohexylphenyl ketones, trimethylbenzophenones, polymeric hydroxy ketones, trimethylbenzoylphenylphosphine oxides, and mixtures thereof.

7. The overprint composition of claim 6, wherein the photoinitiator is 1-hydroxycyclohexylphenyl ketone.

8. The overprint composition of claim 6, wherein the photoinitiator is a mixture of 1-hydroxycyclohexylphenyl ketone and ethyl-2,4,6-trimethylbenzoylphenylphosphinate.

9. A system for creating an image on a substrate, comprising: toner, a photoconductive imaging member, a radiation curable overprint composition, and a substrate;

wherein the overprint composition comprises:

at least one oligomer chosen from the group consisting of polyether acrylate oligomers, at least one monomer chosen from the group consisting of di-acrylate monomers, alkoxylated di-acrylate monomers, polalkoxylated di-acrylate monomers, tri-acrylate monomers, allkoxylated tri-acrylate monomers, polyalkoxylated tri-acrylate monomers, at least one photoinitiator, and at least one surfactant, wherein an oligomer:monomer ratio is in a range of from about 1.5:1 to about 4:1; and wherein the overprint composition-coated print, after curing, has a thermal cracking area value of about 0% to about 0.05% after thermal shock.

10. The system of claim 9, further comprising a radiation source for curing the overprint composition on the xerographic substrate.

11. A toner-based print, comprising a substrate having a toner-based image thereon coated with the overprint composition of claim 1.

12. A process for forming a toner-based image, comprising:

generating an electrostatic image;

developing the electrostatic image with toner; transferring the developed toner-based image onto a substrate;

applying to the developed toner-based image, a radiation curable overprint composition comprising:

at least one oligomer chosen from the group consisting of polyether acrylate oligomers, at least one monomer chosen from the group consisting of di-acrylate monomers, alkoxylated di-acrylate monomers, polyalkoxylated di-acrylate monomers, tri-acrylate monomers, alkoxylated tri-acrylate monomers, polyalkoxylated tri- acrylate monomers, at least one photoinitiator, and at least one surfactant, wherein an oligomer:monomer ratio is in a range of from about 1.5:1 to about 4:1; and curing the overprint composition;

wherein the overprint composition-coated print, after curing, has a thermal cracking area value of about 0% to about 0.05% after thermal shock.

13. The process of claim 12, wherein the overprint composition is cured by ultraviolet radiation.

14. A process for preventing or reducing thermal cracking on a toner-based printed image, comprising:

obtaining a toner-based image on a substrate;

applying to the toner-based image, a radiation curable overprint composition composition comprising:

at least one oligomer chosen from the group consisting of polyether acrylate oligomers, at least one monomer chosen from the group consisting of di-acrylate monomers, alkoxylated di-acrylate monomers, polyalkoxylated di-acrylate monomers, tri-acrylate monomers, alkoxylated tri-acrylate monomers, polyalkoxylated tri-acrylate monomers, at least one photoinitiator, and at least one surfactant, wherein an oligomer:monomer ratio is in a range of from about 1.5:1 to about 4:1;

curing the overprint composition; and subjecting the toner-based image to thermal shock;

wherein the overprint composition-coated print, after curing, has a thermal cracking area value of about 0% to about 0.05% after thermal shock.

15. The process of claim 14, wherein the overprint composition is cured by ultraviolet radiation.

16. The process of claim 14, wherein the overprint composition comprises about 60 to about 70% of a polyether acrylate oligomer, about 20 to about 40% of a propoxylated$_2$ neopentyl glycol diacrylate, about 2.0 to about 7.0% of a ultraviolet light photoinitiator, and about 0.1 to about 1.0% of a surfactant.

17. The process of claim 14, wherein the thermal shock is electron beam irradiation.

* * * * *